US006897384B2

(12) United States Patent
Fujii

(10) Patent No.: US 6,897,384 B2
(45) Date of Patent: May 24, 2005

(54) POLYMER INSULATOR APPARATUS AND METHOD OF MOUNTING SAME

(75) Inventor: Shuji Fujii, Komaki (JP)

(73) Assignee: NGK Insulators, Ltd. (JP)

( * ) Notice: Subject to any disclaimer, the term of this patent is extended or adjusted under 35 U.S.C. 154(b) by 0 days.

(21) Appl. No.: 10/742,393

(22) Filed: Dec. 22, 2003

(65) Prior Publication Data

US 2004/0135133 A1 Jul. 15, 2004

(30) Foreign Application Priority Data

Dec. 27, 2002 (JP) ..... 2002-380961

(51) Int. Cl.[7] ..... H01B 17/14
(52) U.S. Cl. ..... 174/150; 174/140 S; 174/141 R
(58) Field of Search ..... 174/138 B, 140 S, 174/141 C, 141 R, 145, 148, 149 R, 150, 158 R

(56) References Cited

U.S. PATENT DOCUMENTS

| | | | | | |
|---|---|---|---|---|---|
| 872,569 | A | * | 12/1907 | Locke | 174/148 |
| 1,077,711 | A | * | 11/1913 | Hewlett | 174/191 |
| 1,275,918 | A | * | 8/1918 | Hewlett | 174/140 R |
| 1,730,124 | A | * | 10/1929 | Conrad | 174/140 R |
| 1,828,281 | A | * | 10/1931 | Crabbs | 174/167 |
| 1,829,893 | A | * | 11/1931 | Fischer | 174/150 |
| 1,983,903 | A | * | 12/1934 | Hawley | 174/141 R |
| 2,278,330 | A | * | 3/1942 | Meyer | 174/148 |
| 2,427,975 | A | * | 9/1947 | Pittman | 174/141 R |
| 2,436,290 | A | * | 2/1948 | Cole | 174/148 |
| 2,613,913 | A | * | 10/1952 | Hubbard | 174/150 |
| 3,032,606 | A | * | 5/1962 | Phillips | 174/148 |
| 3,069,521 | A | * | 12/1962 | Leigh et al. | 174/148 |
| 3,229,031 | A | * | 1/1966 | Owens et al. | 174/150 |
| 3,229,055 | A | * | 1/1966 | Alexander et al. | 174/150 |
| 3,470,308 | A | * | 9/1969 | Huc | 174/141 R |
| 3,603,721 | A | * | 9/1971 | Foti et al. | 174/141 R |
| 3,745,274 | A | * | 7/1973 | Cole | 174/150 |
| 3,814,838 | A | * | 6/1974 | Shafer | 174/150 |
| 3,832,482 | A | * | 8/1974 | Tragesser et al. | 174/141 R |
| 4,494,173 | A | * | 1/1985 | Ikekame et al. | 174/148 |
| 4,524,404 | A | * | 6/1985 | Verma | 174/141 R |

FOREIGN PATENT DOCUMENTS

| | | | | |
|---|---|---|---|---|
| JP | 5-79817 | | 10/1993 | |
| JP | 406119839 | A * | 4/1994 | 174/150 |

* cited by examiner

*Primary Examiner*—Dean A. Reichard
*Assistant Examiner*—Adolfo Nino
(74) *Attorney, Agent, or Firm*—Parkhurst & Wendel, L.L.P

(57) ABSTRACT

The cantilever and compression strength of a polymer post insulator decreases according to lengthening of lever length of the polymer post insulator. By combining polymer post insulators to construct a structure having an increased strength in an arbitrary direction, a polymer insulator apparatus and a method for mounting the same can provide a sufficient strength and rigidity even as a long insulator for high voltage that requires a long insulation distance. Polymer post insulator columns 12-1, 12-2, in which plural polymer post insulators 1-1 to 1-4 are stacked, are arranged in parallel. The polymer post insulator columns 12-1, 12-2 arranged in parallel are connected with each other via connecting plates 13-1 to 13-3 at each connection site of the polymer post insulators 1-1 to 1-4 constituting the polymer post insulator columns 12-1, 12-2 as well as at the top and bottom of the polymer post insulator columns 12-1, 12-2. Thus, the cantilever strength in a direction of arranging the polymer post insulator columns 12-1, 12-2 in parallel is increased, and also the compression strength in a direction of stacking the polymer post insulators 1-1 to 1-4 is increased.

5 Claims, 7 Drawing Sheets

POLYMER INSULATOR APPARATUS AND METHOD OF MOUNTING SAME

REFERENCE TO RELATED APPLICATION

This application claims priority from Japanese Application 2002-380961 filed Dec. 27, 2002, the entireties of which is incorporated herein by reference.

BACKGROUND OF THE INVENTION

1. Field of the Invention

The present invention relates to a post insulator that receives a large compression load by supporting an electric conductor, a switching device, or the like, for example, in a substation. In particular, the present invention relates to an insulator apparatus constituted with polymer post insulators and to a method of mounting the same.

2. Description of the Background Art

Hitherto, since post insulators used in a substation not only support an electric conductor but also are structural members constituting a transformer apparatus, a high rigidity is required and also, in a post insulator that supports an opening/closing part of a switching device, a strict position control is required in order to ensure an accurateness in repetition of switching operation. For this reason, insulators made of porcelain being excellent in rigidity have been used as station posts. However, insulators made of porcelain are brittle, and are not durable against a dynamic stress such as generated in a large earthquake or the like. Polymer post insulators are constructed with a solid FRP core for supporting mechanical load such as cantilever and compression, an outer cover having a weather resistance such as a silicone rubber for protecting the FRP core and imparting a suitable leakage distance to the insulator, and metal fitting pieces for connecting the insulator to a supporting structure and to an electric conductor or the like. Since polymer post insulators are excellent in earthquake-proof characteristics and contamination-proof characteristics, polymer post insulators are more and more widely used in recent years as insulators for a substation chiefly in coastal areas that often suffer from earthquake and severe contamination.

While porcelain post insulators are little deformed, the aforementioned polymer post insulators are deformed by being deflected against cantilever load and are deformed by being buckled against compression load. Such deformations increase according as the insulators increase in length, and also the strength decreases according as the insulators increase in length. For this reason, in application of polymer post insulators for substations, insufficient rigidity of the polymer post insulators is a problem particularly for high voltage that requires a long insulation distance.

An object of the present invention is to solve the aforementioned problems of the prior art and to provide a polymer insulator apparatus that can increase the strength in a desired direction and can be applied to a station post for high voltage that requires a long length and to a method of mounting the same.

SUMMARY OF THE INVENTION

A polymer insulator apparatus according to the present invention is such that polymer post insulator columns, in which plural polymer post insulators are stacked, are arranged in parallel, and the polymer post insulator columns arranged in parallel are connected with each other via a connecting plate at each connection site of the polymer insulator constituting the polymer insulator columns as well as at the top and bottom of the polymer post insulator columns, whereby the cantilever strength in a direction of arranging the polymer post insulator columns in parallel is increased, and also the compression strength in a direction of stacking the polymer post insulators is increased.

A method of mounting a polymer insulator apparatus according to the present invention is such that, in mounting the above-described polymer insulator apparatus vertically onto a base, the polymer insulator apparatus is mounted so that the direction of arranging the polymer post insulator columns in parallel will be a direction of cantilever load and the direction of stacking the polymer post insulators will be a direction of compression load.

In the present invention, polymer post insulator columns, in which plural polymer post insulators are stacked, are arranged in parallel, and the polymer post insulator columns arranged in parallel are connected with each other via a connecting plate at each connection site of the polymer insulator consisting the polymer insulator columns as well as at the top and bottom of the polymer post insulator columns. Therefore, in mounting the above-described polymer insulator apparatus vertically onto a base, the polymer post insulator apparatus can be mounted so that the direction of arranging the polymer post insulator columns in parallel will be a direction of cantilever load and the direction of stacking the polymer post insulators will be a direction of compression load. For this reason, the strength in the direction of cantilever load and the strength in the direction of compression load in particular can be improved.

Of course, the strength in a desired direction can be improved by setting the direction of parallel arrangement of the polymer post insulator columns to be an arbitrary direction. Also, the strength in a direction other that the direction of improved strength can be improved as compared with the strength in a case of a single polymer post insulator, though the improvement is not great as in the direction of improved strength. Further, the polymer insulator apparatus according to the present invention is constructed in such a manner that polymer post insulator columns, in which plural polymer post insulators are stacked, are arranged in parallel, and the polymer post insulator columns arranged in parallel are connected with each other via a connecting plate at each connection site of the polymer insulator constituting the polymer insulator columns as well as at the top and bottom of the polymer post insulator columns. Therefore, a long polymer insulator apparatus can be obtained easily while maintaining the diameter of the FRP core of each polymer post insulator constituting the polymer insulator apparatus to be of the same degree as in the prior art.

Furthermore, in a preferable mode, the polymer post insulator columns are arranged in parallel in the direction of the cantilever load generated by opening and closing of a switching device. Disposing the polymer post insulator columns in such a manner is preferable because of the following reason. When a switching device of a substation is constructed with the polymer insulator apparatus of the present invention, the cantilever load imposed upon the top by an operation of the opening/closing part is applied in the direction of great improvement of the strength of the polymer insulator apparatus. Therefore, a sufficient position precision can be maintained against a larger cantilever load, and also the polymer insulator apparatus can exhibit a sufficient strength against the compression load imposed upon the polymer insulator apparatus by placing the opening/closing part thereon.

DESCRIPTION OF THE PREFERRED EMBODIMENTS

Figure 1:
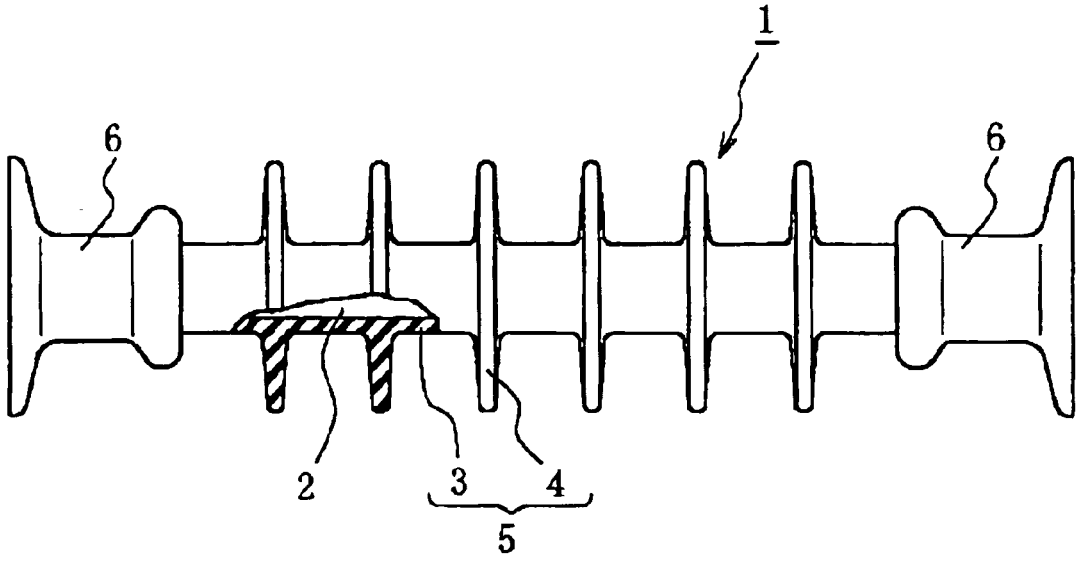
FIG. 1 is a view showing one construction example of a polymer post insulator constituting a polymer insulator apparatus according to the present invention.

FIG. 1 is a view showing one construction example of a polymer post insulator constituting a polymer insulator apparatus according to the present invention. In the example shown in FIG. 1, a polymer post insulator 1 is constituted with a core member 2, an outer cover 5 constructed by a sheath 3 and sheds 4 disposed around core member 2, and holding metal fitting pieces 6 disposed at two ends of core member 2. Further, core member 2 is made of a solid FRP, and outer cover 5 constructed by sheath 3 and sheds 4 is made of, for example, silicone rubber. Also, an end of holding metal fitting piece 6 has a flange shape, and is constituted to be capable of being fixed onto a planar plate member or the like with screws. The construction of this polymer post insulator is the same as in the prior art.

Figure 2:
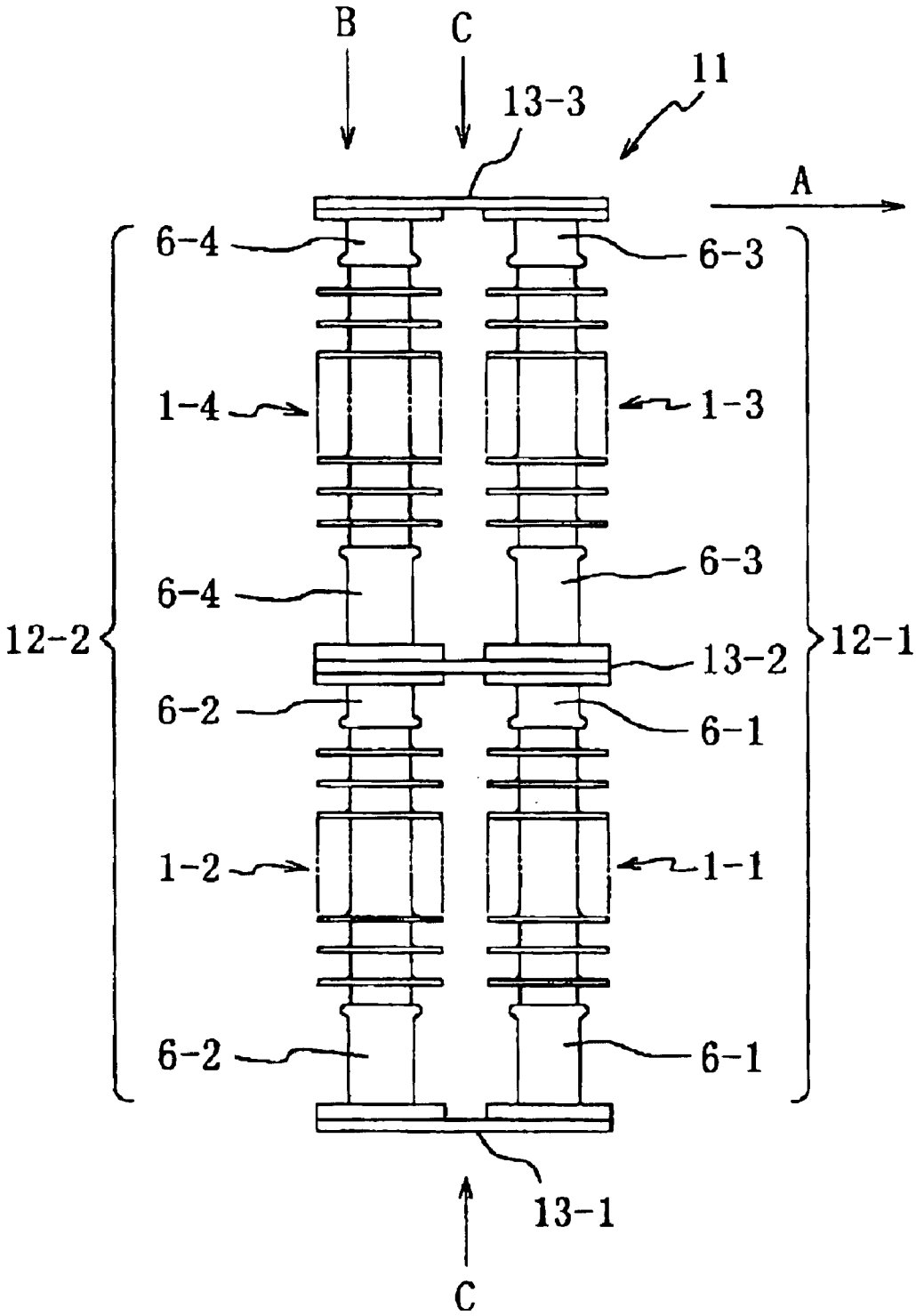
FIG. 2 is a view showing one construction example of a polymer insulator apparatus according to the present invention.

FIG. 2 is a view showing one example of a polymer insulator apparatus according to the present invention. In the example shown in FIG. 2, a polymer insulator apparatus 11 according to the present invention is constructed in such a manner that polymer post insulator columns 12-1, 12-2, in which a plurality of (here, two) polymer post insulators 1-1, 1-3 and 1-2, 1-4 are stacked, are arranged in parallel, and polymer post insulator columns 12-1, 12-2 arranged in parallel are connected with each other via connecting plates 13-1 to 13-3 at each connection site of polymer post insulators 1-1 to 1-4 constituting the polymer post insulator columns 12-1, 12-2 and at the top and bottom of the polymer post insulator columns 12-1, 12-2.

The connection between polymer post insulators 1-1, 1-2 and connecting plate 13-1 at the bottom of polymer insulator apparatus 11 is achieved by fixing the flange-shaped parts located at the end of holding metal fitting pieces 6-1, 6-2 of polymer post insulators 1-1, 1-2 onto connecting plate 13-1 with screws. Similarly, the connection between polymer post insulators 1-3, 1-4 and connecting plate 13-3 at the top of polymer insulator apparatus 11 is achieved by fixing the flange-shaped parts located at the end of holding metal fitting pieces 6-3, 6-4 of polymer post insulators 1-3, 1-4 onto connecting plate 13-3 with screws. Further, the connection between polymer post insulators 1-1 to 1-4 and connecting plate 13-2 at the connection site of polymer insulator apparatus 11 is achieved by disposing flange-shaped holding metal fitting pieces 6-1 to 6-4 located at the end of polymer post insulators 1-1 to 1-4 via connecting plate 13-2 with holding metal fitting pieces 6-1 and 6-3 and holding metal fitting pieces 6-2 and 6-4 respectively forming pairs, and integrally fixing the set of holding metal fitting piece 6-1, connecting plate 13-2, and holding metal fitting piece 6-3 and the set of holding metal fitting piece 6-2, connecting plate 13-2, and holding metal fitting piece 6-4 set by set with screws.

Regarding the cantilever strength of polymer insulator apparatus 11 of the present invention constructed as shown in FIG. 2, when a cantilever load (shown by arrow A) is applied to connecting plate 13-3 at the column top with connecting plate 13-1 fixed and polymer insulator apparatus 11 standing upright, the apparatus exhibits a high strength because of having a rigid frame structure in which polymer post insulators 1-1 to 1-4 arranged in parallel and connected with each other are stacked.

Figure 3A:
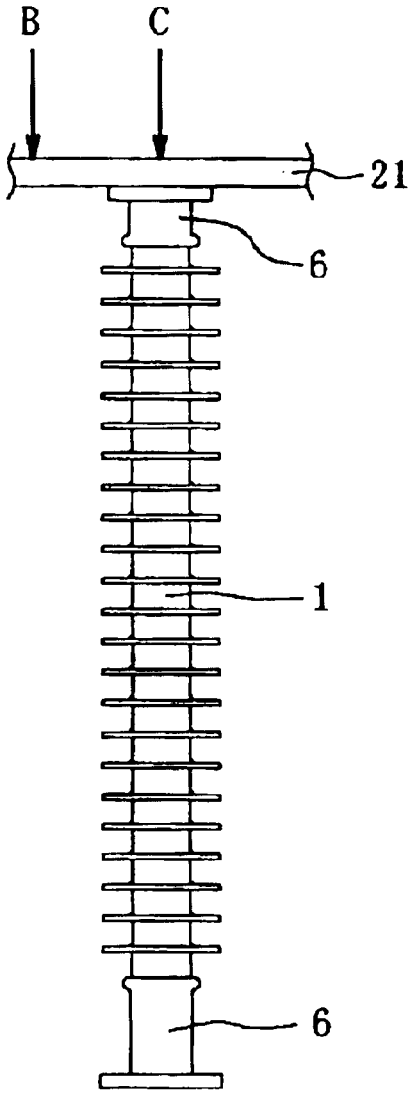
FIG. 3A is a view showing one example of a polymer insulator apparatus constituted with one polymer post insulator.
Figure 3B:
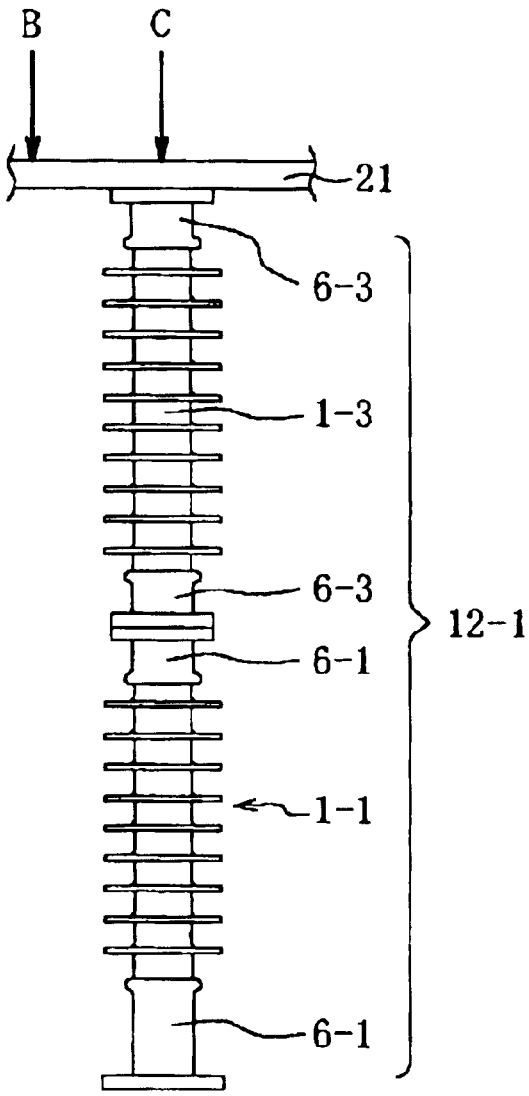
FIG. 3B is a view showing one example of a polymer insulator apparatus in which two polymer post insulators are stacked in a line.
Figure 4A:
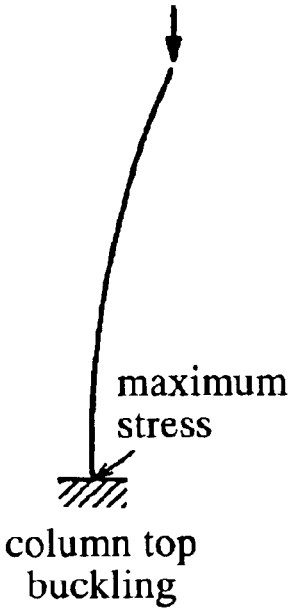
FIG. 4A is a view showing a column top buckling mode.

When compression load (shown by arrow B) off the central axis of the polymer post insulator is applied to a single polymer post insulator 1 shown in FIG. 3A and to a polymer post insulator column 12-1 shown in FIG. 3B, in which a plurality of (here, two) polymer post insulators 1-1 and 1-3 are stacked, via a structure 21 supported by polymer post insulator 1 or polymer post insulator column 12-1, a column top buckling mode such as shown in FIG. 4A will appear where the buckling strength against the compression load is approximately equal to the formula obtained by Euler's buckling theory: $W=(1/4)\cdot\pi^2 EIz\div L^2$. Here, W, π, E, Iz, and L represent the buckling load, circle circumference diameter ratio, elastic modulus, area moment of inertia, and length of the column, respectively.

Figure 4B:
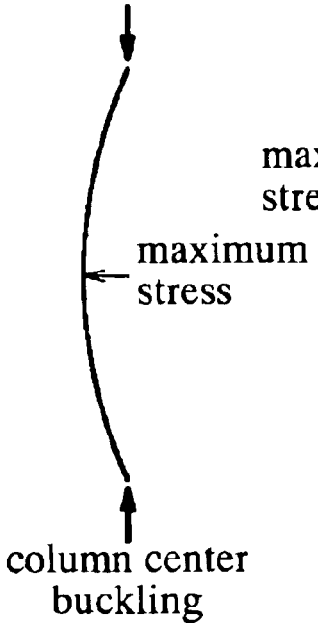
FIG. 4B is a view showing a column center buckling mode in a case of one column.

When compression load (shown by arrow C) is applied to a single polymer post insulator 1 shown in FIG. 3A and to a polymer post insulator column 12-1 shown in FIG. 3B, in which a plurality of (here, two) polymer post insulators 1-1 and 1-3 are stacked, onto the central axis of polymer post insulator 1 or polymer post insulator column 12-1, a column center buckling mode such as shown in FIG. 4B will appear where the buckling strength against the compression load is approximately equal to the formula obtained by Euler's buckling theory: $W=\pi^2 EIz\div L^2$.

Figure 4C:
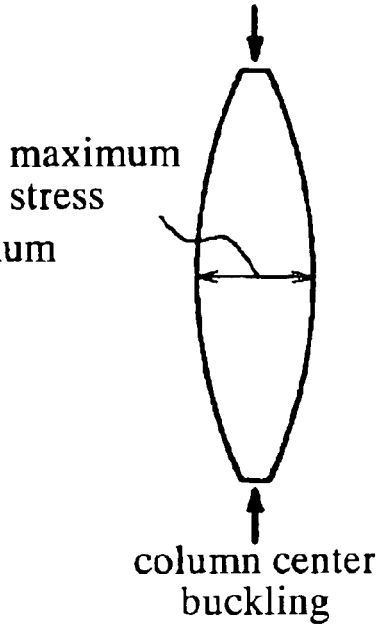
FIG. 4C is a view showing a column center buckling mode in a case of two columns.

Therefore, even with the same polymer post insulator column, when the buckling mode assumes the column center buckling mode, the polymer post insulator column exhibits compression strength four times as large as the compression strength when the buckling mode assumes the column top buckling mode. FIG. 4C shows a phase of buckling deformation in the case of a structure in which two columns are arranged in parallel with both ends thereof fixed, i.e. the case where compression load is applied onto the central axis of the rigid frame structure. If the column length L remains the same, the exhibited buckling strength is two times as large as that of the column center buckling mode of one column shown in FIG. 4B and is eight times as large as that of the column top buckling mode of one column shown in FIG. 4A.

In polymer insulator apparatus 11 of the present invention constructed as shown in FIG. 2, polymer post insulator column 12-1, which is constructed with polymer post insulators 1-1 and 1-3, and polymer post insulator column 12-2, which is constructed with polymer post insulators 1-2 and 1-4, are arranged in parallel; the top and the bottom thereof are connected with connecting plates 13-1 and 13-3; and the central part of the columns are connected and fixed with connecting plate 13-2. By the function of connecting plate 13-2 located at the central part, the deformation of column center buckling shown in FIG. 4C can be completely restrained.

Therefore, when compression load is applied to polymer insulator apparatus 11, each of polymer post insulators 1-1 to 1-4 assumes the column center buckling mode, so that the length of the column applied to Euler's formula will be the length of individual polymer post insulators 1-1 to 1-4, which is about half of the length of polymer insulator apparatus 11. As is apparent from Euler's formula, the buckling strength thereof is inversely proportional to the square of the length L of the column. Thus, when the length of the column becomes, for example, half of the original length, the buckling strength will be the inverse of the square of half, which is four times the original buckling strength. Therefore, the buckling strength of polymer insulator apparatus 11 shown in FIG. 2 is, with respect to a column having a similar column length L, eight times as large as the buckling strength of the column center buckling mode of one column shown in FIG. 4B, and thirty two times as large as the buckling strength of the column top buckling mode of one column shown in FIG. 4A.

In order to obtain a buckling strength of the same degree as that of polymer insulator apparatus 11 of the present invention by using single polymer post insulator column, an FRP core having 2.38 times the FRP diameter and having 5.66 times the FRP weight is needed as compared with an existing typical polymer post insulator used in polymer post insulators 1-1 to 1-4 of polymer insulator apparatus 11. Thus, by combining existing typical polymer post insulators, a polymer insulator apparatus 11 of the present invention with less deformation and in particular with reinforced buckling strength can be obtained.

Figure 5:
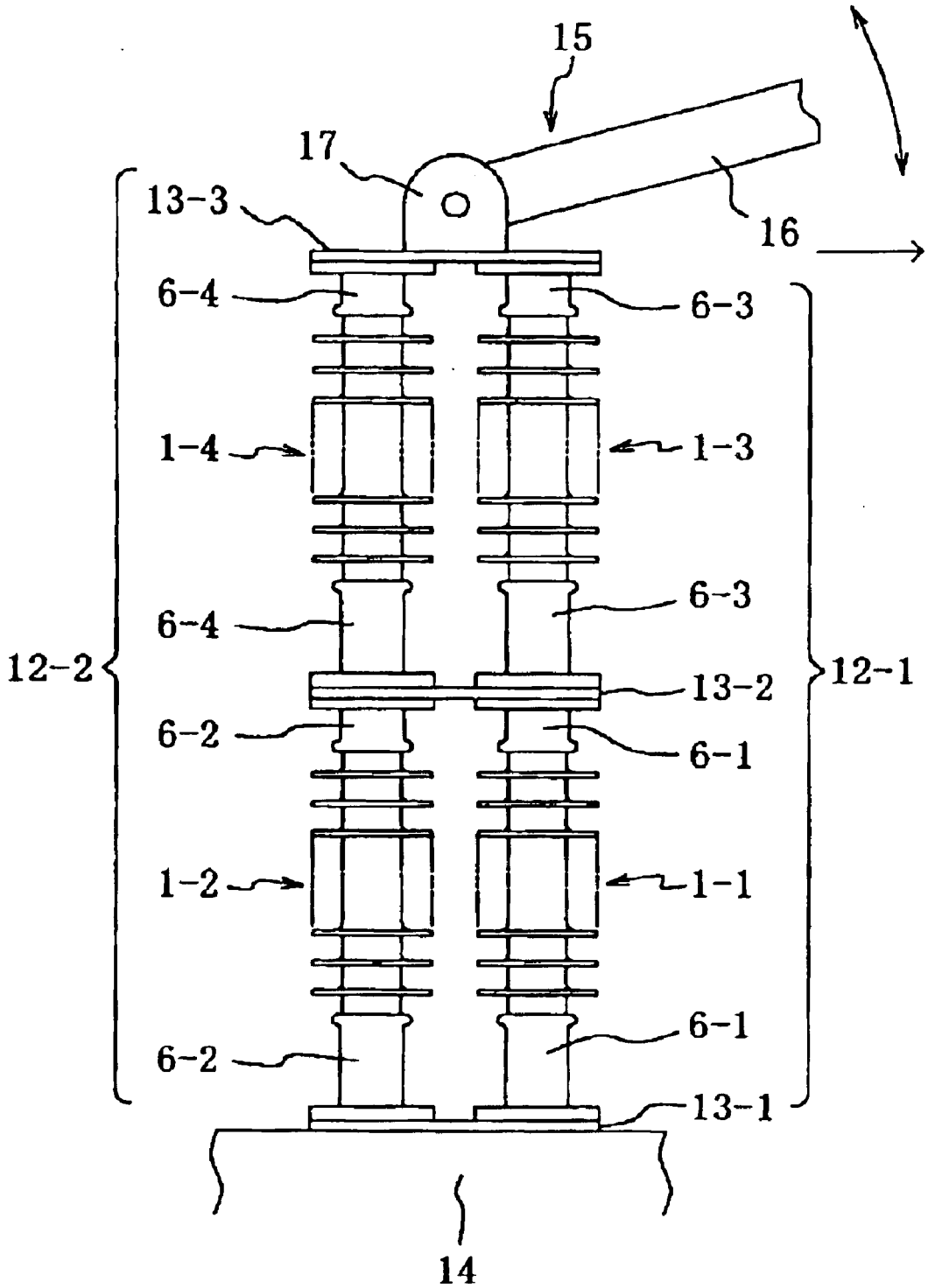
FIG. 5 is a view for describing one example of a method for mounting a polymer insulator apparatus according to the present invention.

FIG. 5 is a view for describing one example of a method for mounting a polymer insulator apparatus according to the present invention. FIG. 5 shows an example in which the polymer insulator apparatus 11 of the present invention is used as one example of a switching device that opens and closes in an up-and-down direction in a substation or the like. In the example shown in FIG. 5, connecting plate 13-1 is fixed onto base 14 with screws, and polymer insulator apparatus 11 is mounted onto base 14 by disposing an opening/closing part mounting part 17 that is disposed on connecting plate 13-3 and connects the opening/closing part 16 of switching device 15 in a freely rotatable manner so that the cantilever load direction, here, the direction (shown by arrows) parallel to the plane of the operation (both directions shown by the arrows) of the opening/closing part 16 of switching device 15 will be the direction of parallel arrangement and connection of polymer post insulators 1-1 to 1-4.

Figure 6:
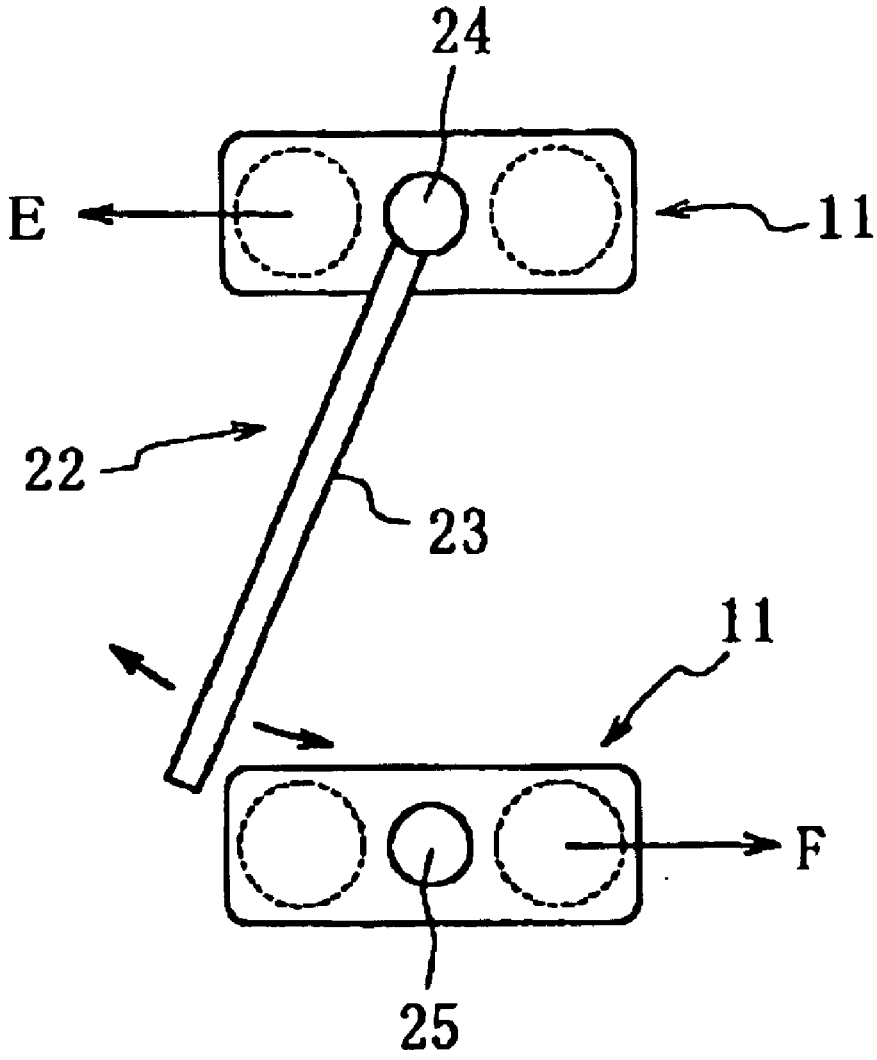
FIG. 6 is a view for describing another example of a method for mounting a polymer insulator apparatus according to the present invention.

FIG. 6 is a view for describing another example of a method for mounting a polymer insulator apparatus according to the present invention. FIG. 6 shows an example in which the polymer insulator apparatus 11 of the present invention is used as one example of a switching device that opens and closes by swiveling in a substation or the like. In the example shown in FIG. 6, a switching device 22 having a swiveling opening/closing part 23 and an opening/closing part mounting part 24 for connecting the swiveling opening/closing part 23 in a freely rotatable manner is disposed on a polymer insulator apparatus 11 fixed onto a base (not illustrated) with screws. Further, a switching device 25 for connecting the swiveling opening/closing part 23 is disposed on another polymer insulator apparatus 11 fixed onto a base (not illustrated) with screws, which is different from the above-described one. In this case, the polymer insulator apparatus 11 are respectively mounted onto the bases (not illustrated) by disposing the polymer insulator apparatus 11 so that the direction E, F of the load generated at the time of connecting the swiveling opening/closing part 23 to the switching device 25 will be the direction of parallel arrangement and connection of the polymer post insulators 1-1 to 1-4.

Thus, the polymer insulator apparatus of the present invention, which is constructed in such a manner that polymer post insulator columns, in which plural polymer post insulators are stacked, are arranged in parallel, and the polymer post insulator columns arranged in parallel are connected with each other via a connecting plate at each connection site of the polymer insulator constituting the polymer insulator columns as well as at the top and bottom of the polymer post insulator columns, can improve the strength against cantilever load and the buckling strength against compression load without increasing the diameter of the FRP of the polymer post insulators, by using already existing polymer post insulators. Therefore, the apparatus in particular can be suitably used as a substitute for a single polymer post insulator for high voltage, which tends to be long. With the use of the polymer insulator apparatus of the present invention, the polymer post insulators of 500 kV or higher that currently use a hollow core member in view of the strength can be replaced, and also the limit of the use of the polymer post insulators that are applied only up to 69 kV as a switching device in view of the problem of deflection can be raised to 115 kV class or higher.

Figure 7:
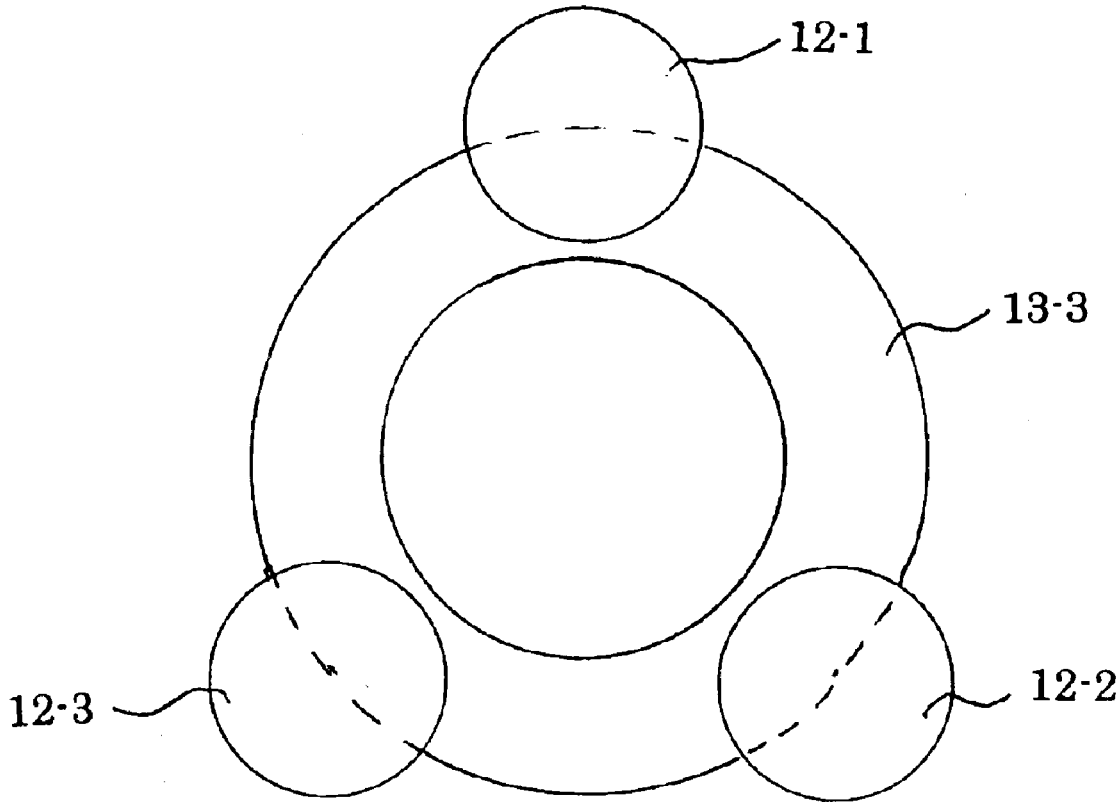
FIG. 7 is a top view of one example of a polymer insulator apparatus having polymer post insulators arranged in a polygon.

Here, in the embodiment described above, polymer insulator apparatus 11 is constructed by arranging in parallel and connecting two polymer post insulator columns 12-1, 12-2 which are constructed by stacking two polymer post insulators 1-1, 1-3 or 1-2, 1-4. However, this is only an example, and it goes without saying that the number of stacked polymer post insulators is not limited to two, that the number of polymer post insulator columns, each constructed by stacking polymer post insulators, arranged in parallel and connected with each other is not limited to two, and that, if the number of polymer post insulator columns is three or more, the polymer post insulator columns arranged in parallel may be disposed not only in a line but also to form a polygon such as a triangle (FIG. 7) or a quadrangle as viewed from above. Furthermore, in the embodiment described above, the end of holding metal fitting pieces 6-1 to 6-4 has a flange shape, and holding metal fitting pieces 6-1 to 6-4 are fixed to connecting plates 13-1 to 13-3 with screws. However, it goes without saying that the holding metal fitting pieces 6-1 to 6-4 may be fixed onto connecting plates 13-1 to 13-3 with any means as long as they can be fixed.

As will be apparent from the above description, according to the present invention, polymer post insulator columns, in which plural polymer post insulators are stacked, are arranged in parallel, and the polymer post insulator columns arranged in parallel are connected with each other via a connecting plate at each connection site of the polymer insulator constituting the polymer insulator columns as well as at the top and bottom of the polymer post insulator columns. Therefore, in mounting the polymer insulator apparatus vertically onto a base, the polymer insulator apparatus can be mounted so that the direction of arranging the polymer post insulator columns in parallel will be a direction of cantilever load and the direction of stacking the polymer post insulators will be a direction of compression load. Thus, in particular, the strength in the cantilever load direction and the strength in the compression load direction can be improved.

What is claimed is:

1. A polymer insulator apparatus comprising:

polymer post insulator columns each having a first end and second end and comprising stacked, parallel plural polymer post insulators each having a plurality of connection sites; and a plurality of connecting plates, wherein:

said polymer post insulator columns are connected to each other via one of said connecting plates at each connection site of the polymer post insulators as well as at first and second opposing ends of the polymer post insulator columns, and said connecting plates are configured to minimize a first displacement at the first end of each polymer insulator column against a compression load in a stacking direction of the polymer post insulators, and to minimize the second displacement at the first end of each polymer post insulator column against a cantilever load in a direction substantially perpendicular to the stacking direction of the polymer post insulators.

2. The polymer insulator apparatus according to claim 1, wherein the polymer post insulator columns are arranged to form a polygon.

3. A method of mounting a polymer insulator apparatus comprising:

providing a polymer insulator apparatus comprising:

polymer post insulator columns each having a first end and second end and comprising stacked, parallel plural polymer post insulators each having a plurality of connection sites; and a plurality of connecting plates, wherein:

said polymer post insulator columns are connected to each other via one of said connecting plates at each connection site of the polymer post insulators as well as at first and second opposing ends of the polymer post insulator columns, and said connecting plates are configured to minimize a first displacement at the first end of each polymer insulator column against a compression load in a stacking direction of the polymer post insulators, and to minimize the second displacement at the first end of each polymer post insulator column against a cantilever load in a direction substantially perpendicular to the stacking direction of the polymer post insulators; and mounting the polymer insulator apparatus onto a base so that the parallel polymer post insulators are oriented in a substantially vertical direction.

4. The method according to claim 3, further comprising attaching the polymer post insulator columns to a switching device, wherein the polymer post insulator columns are arranged in parallel in the same direction as the direction of cantilever load generated by opening and closing of said switching device.

5. The method according to claim 3, wherein the polymer post insulator columns are arranged to form a polygon.

* * * * *